US005085963A

United States Patent [19]

Suzuki et al.

[11] Patent Number: 5,085,963

[45] Date of Patent: Feb. 4, 1992

[54] DRY DEVELOPER WITH POLYETHYLENE POWDER

[75] Inventors: Chiaki Suzuki; Koichi Kumashiro; Tetsu Torigoe; Takaichi Kimura; Takayoshi Aoki, all of Kanagawa, Japan

[73] Assignee: Fuji Xerox Co., Ltd., Tokyo, Japan

[21] Appl. No.: 584,638

[22] Filed: Sep. 19, 1990

[30] Foreign Application Priority Data

Sep. 26, 1989 [JP] Japan ..... 1-248135

[51] Int. Cl.[5] ..... G03G 9/097; G03G 9/107

[52] U.S. Cl. ..... 430/106.6; 430/108; 430/110; 430/111

[58] Field of Search ..... 430/106.6, 110, 108, 430/111

[56] References Cited

U.S. PATENT DOCUMENTS

| | | | |
|---|---|---|---|
| 4,051,077 | 9/1977 | Fisher | 430/110 |
| 4,626,487 | 12/1986 | Mitsuhashi | 430/106.6 X |
| 4,994,340 | 2/1991 | Yamazaki et al. | 430/111 X |
| 5,013,626 | 5/1991 | Matsumura et al. | 430/108 |

*Primary Examiner*—Roland Martin

*Attorney, Agent, or Firm*—Finnegan, Henderson, Farabow, Garrett and Dunner

[57] ABSTRACT

A dry developer for an electrophotographic process, said dry developer being composed of a toner and a dispersion type carrier composed of a resin and a magnetic powder, wherein polyethylene having a molecular weight of not larger than 10,000, a density of at least 0.95, and an average volume diameter of not larger than 15 μm is externally added to the toner or directly mixed with the developer. The dry developer shows good fluidity and cleaning property, is excellent in environmental stability and durability, and can prevent the occurrence of the toner film phenomenon on a photoreceptor or carrier surfaces.

8 Claims, No Drawings

DRY DEVELOPER WITH POLYETHYLENE POWDER

FIELD OF THE INVENTION

This invention relates a dry developer which is used for developing electrostatic latent images in an electrophotographic process or an electrostatic recording process.

BACKGROUND OF THE INVENTION

A dry developer can be classified into a one component developer using a toner alone, which is formed by dispersing a coloring agent in a binder resin and a two-component developer composed of a mixture of the aforesaid toner and a carrier. An electrostatic latent image formed on a photoreceptor, etc., is developed by the aforesaid developer and after transferring the toner image formed to a transfer sheet or paper, toners remaining on the photoreceptors are cleaned. Accordingly, the dry developer is required to meet various conditions in the photocopying step, in particular, the development step or the cleaning step. In particular, a toner is used for the development as each particle without the aggregate thereof at development, and for the purpose, it is necessary that the toner has a sufficient fluidity and also the fluidity or the electric property thereof does not change with the passage of time or by the change of environmental conditions (e.g., temperature and humidity). Also, in the two-component developer, it is required that the developer does not cause so-called toner filming, i.e., a phenomenon of sticking the toner onto the carrier surface.

Furthermore, the toner is required to have such cleaning properties that the remaining toners can be easily removed from the surface of the photoreceptor at cleaning and that when a cleaning member such as a blade, web, etc., is used for cleaning the remaining toners, they do not injure the surface of the photoreceptor.

For meeting these requirement, as a dry developer, various one-component developers or two-component developers prepared by adding an inorganic fine powder such as silica, etc., an organic fine powder such as a fatty acid or a derivative or metal salt thereof, etc., a fine powder of a fluorine series resin, etc., to a toner have been proposed to improve, thereby, the fluidity, the durability, or the cleaning property thereof.

However, in the conventionally proposed additives for toners, an inorganic oxide such as silica, titania, alumina, etc., greatly improves the fluidity of the developer but since the inorganic oxide itself is considerably hard, there are problems that they dent and injure the surface of the photoreceptor and as a result, the toners stick to these portions.

Also, for an organic belt photoreceptor for a high-speed copying machine, a cleaning system using a rubber blade or a brush is employed but as compared to the cleaning system for a conventional drum photoreceptor, the cleaning performance is greatly reduced by the distortion, bending, etc., of the organic belt photoreceptor, and in particular, there sometimes occurs that a paper dust, etc., enters between the photoreceptor and the blade to cause poor cleaning.

Furthermore, recently, a requirement for a low-potential high-developing property has been increased, and thus, low-specific gravity low-magnetic force dispersion type carriers composed of a resin and a magnetic powder as essential components have been used.

However, such a carrier has a problem that the carrier is liable to attach to the surface of the photoreceptor and injures the surface of the photoreceptor at cleaning.

SUMMARY OF THE INVENTION

Thus, the object of the present invention is to solve the aforesaid problems and to provide a dry developer which shows good fluidity and cleaning property, is excellent in environmental stability and durability, and can prevent the occurrence of the toner filming phenomenon on a photoreceptor or carrier surfaces.

It has now been discovered that the aforesaid object can be attained by the present invention as described below.

That is, the present invention is a dry developer for an electrophotographic process of the type of carrying out cleaning of toners by pressing a rubber blade, a brush, etc., onto the surface of an organic belt photoreceptor, the developer being composed of a toner and a dispersion type carrier having a resin and a magnetic powder, wherein polyethylene having a molecular weight of not larger than 10,000, a density of at least 0.95, and an average volume diameter of not larger than 15 μm is externally added to the toner or is directly mixed with the developer.

DETAILED DESCRIPTION OF THE INVENTION

Then, the present invention is described in detail.

With respect to the polyethylene used in the present invention, the lower limit of the molecular weight is preferably 900 and the upper limit of the density is preferably 0.99.

In this invention, the content of polyethylene contained in the dry developer is preferably from 0.01 to 10% by weight, more preferably from 0.2 to 2% by weight based on the total weight of the toner. If the content is less than 0.01% by weight, the cleaning property tends to reduce, while the content is over 10% by weight, the frictional electrification property of the toner tends to reduce to lower the developing property.

For externally adding polyethylene to the toner, they may be simply mechanically mixed with each other and the polyethylene may be attached to the surface of the toner in the form of almost dispersion. Also, the fine powders of polyethylene may not coat the whole surface of the toner particle and the toner may be coated with partial aggregates of the polyethylene fine powders, but it is preferred that the toner is coated with a single layer of the fine powders.

The dry developer of the present invention is used as a two-component developer composed of the aforesaid toner and a dispersion type carrier.

For forming the two-component developer, the toner previously externally added with the polyethylene fine powder may be mixed with the carrier, or the toner, the carrier and the polyethylene fine powder may be simultaneously blended. In this case, a twin-cylinder mixer, a Henschel mixer, etc., can be used.

Now, a toner is mainly composed of a binder resin and coloring agent.

As the binder resin being used, there are homopolymers or copolymers of: styrenes such as styrene, chlorostyrene, etc.; monoolefins such as ethylene, propylene, butylene, isobutylene, etc.; vinyl esters such as vinyl acetate, vinyl propionate, vinyl benzoate, vinyl butyrate, etc.; α-methylene aliphatic monocarboxylic acid esters such methyl acrylate, ethyl acrylate, butyl acrylate, dodecyl acrylate, octyl acrylate, phenyl acrylate, methyl methacrylate, ethyl methacrylate, butyl methacrylate, dodecyl methacrylate, etc.; vinyl ethers such as vinyl methyl ether, vinyl ethyl ether, vinyl butyl ether, etc.; vinyl ketones such as vinyl methyl ketone, vinyl hexyl ketone, vinyl isopropenyl ketone, etc.

Typical examples of the binder resin are polystyrene, a styrene-alkyl methacrylate copolymer, a styrene-alkyl methacrylate copolymer, a styrene-acrylonitrile copolymer, a styrene-butadiene copolymer, a styrene-maleic anhydride copolymer, polyethylene, and polypropylene.

Furthermore, polyester, polyurethane, an epoxy resin, a silicone resin, polyamide, modified rosin, paraffin, waxes, etc., can be also used as the binder resin.

Also, typical examples of the coloring agent for use in the present invention are carbon black, Aniline Blue, calcoil blue, chrome yellow, Ultramarine Blue, Dupont Oil Red, Quinoline Yellow, Methylene Blue Chloride, Phthalocyanine Blue, Malachite Green Oxalate, lamp black, and Rose Bengale.

In addition, the components of the toner are not limited to the binder resin and the coloring agent only but if necessary, the toner may further contain a static controlling agent (e.g., quaternary ammonium salt, nigrosine, metal complex salt, etc.), a cleaning aid (e.g., fatty acid metal salt, organic resin fine particles, long-chain alcohol, etc.), a fluidity accelerator (e.g., silica, titania, alumina, magnesia, etc.), etc.

Since the polyethylene coating is capable of lowering the coefficient of friction remarkably, when $TiO_2$, $SiO_2$, $Al_2O_3$, etc., is externally added to the toner, attaching of the inorganic particles onto a photoreceptor is prevented, whereby the problems of injuring, etc., do not occur.

Also, the toner used in the present invention may be a magnetic toner or a capsule toner each containing a magnetic substance.

The mean particle size of the toner in the present invention is not larger than about 30 μm, and preferably from 3 to 20 μm.

Then, the carrier is a dispersion type carrier mainly composed of a resin and a magnetic powder.

As the resin, the polymers or copolymers illustrated above as the binder resin for the toner can be used.

Also, as the magnetic powder, fine particles of a ferromagnetic substance which is usually used for such a carrier can be used. Specific examples thereof are triiron tetroxide, iron γ-sesquioxide, various kinds of ferrites, chromium oxide, and various kinds of fine metal powders.

The carrier may further contain a static controlling agent, if necessary.

The carrier in the present invention can be prepared by kneading the aforesaid components, grinding, and classifying or forming a liquid of the components using a solvent or by heating and then spray-drying the liquid.

The mean particle size of the carrier for use in the present invention is from about 20 to 400 μm, and preferably from 30 to 200 μm.

In the present invention, the ratio of carrier to toner contained in the dry developer is generally 90:10 to 98:2 by weight.

The dry developer of the present invention comprises a toner mainly composed of a binder resin and a coloring agent and a dispersion type carrier mainly composed of a resin and a magnetic powder. In the present invention, polyethylene fine powders having a molecular weight of not larger than 10,000, a density of at least 0.95, and an average volume diameter of not larger than 15 μm may be previously externary added to the toner and then the toner may be mixed with the carrier, or the aforesaid polyethylene fine powders may be added at mixing of the toner and the carrier.

The dry developer of the present invention is applied to a high-speed developing system of developing latent images which are travelling at high speed, that is, an electrophotographic system of cleaning an organic belt photoreceptor using a rubber blade, brush, etc. In this case, since the blend of the polyethylene fine powders, a lubricating effect is obtained and a lubricative layer is formed on the surface of the photoreceptor, which gives the effect that blank area or fog is reluctant to form on the images formed. For forming the lubricating film or layer, it is necessary that the molecular weight of the polyethylene being used is not larger than 10,000 and for obtaining the lubricating effect without causing sticking and fusing of the polyethylene fine powders onto a photoreceptor, it is necessary to use the polyethylene fine powders having a density of at least 0.95 and an average volume diameter ($d_{50}$) of not larger than 15 μm, and preferably not larger than 10 μm. The preferred average volume diameter is as small as possible, but about 3 μm is the lower limit for manufacturing purpose.

Then, the following examples and comparison examples are intended to illustrate the present invention but not to limit it in any way. In addition, in the examples and comparison examples, all parts are by weight.

EXAMPLE 1

| | |
|---|---|
| Styrene-butyl acrylate copolymer (80/20 by weight) | 100 parts |
| Carbon black (Regal 330, trade name, made by Cabot Corporation) | 10 parts |
| Low molecular weight polypropylene (Viscol 660P, trade name, made by Sanyo Chemical Industries, Ltd.) | 5 parts |
| Static controlling agent (Bontron N-03, trade name, made by Oritent Kagaku K.K.) | 1 part |

The aforesaid components were melted and kneaded in a Banbury mixer, after cooling, the solidified mixture was finely ground by means of a jet mill and further, the finely ground particles were classified by means of a classifier to provide a toner having an average volume diameter $d_{50}$ of 11 μm.

Then, one part of fine silica particles having an average volume diameter of 0.1 μm and 0.5 part of polyethylene (Ceridust 3620, trade name, made by Hoechst A.G.) having an average volume diameter of 8 μm, a density of 0.97, and a molecular weight of 9000 were dispersion mixed with 100 parts of the toner by means of a blender to prepare a toner.

On the other hand, 100 parts of Styrene-methyl methacrylate (80/20 by weight) copolymer, 200 parts of magnetite (EPT-1000 made by Toda Industries, Ltd.), and 5 parts of polyvinylidene fluoride (KYNAR made by Penn Walt Co., Ltd.) were melted and kneaded in a pressure kneader and further the kneaded mixture was ground and classified using a turbo mill to provide a carrier having an average volume diameter $d_{50}$ of 50 μm.

By mixing the aforesaid toner and carrier with each other at 5:95 by weight ratio, a two-component developer was obtained.

EXAMPLE 2

The same components as in Example 1 were kneaded, ground, and classified to provide a toner having an average volume diameter of 11 μm. Then, 100 parts of the toner were dispersed and mixed with one part of fine titanium oxide particles having an average volume diameter of 0.1 μm and 0.5 part of polyethylene (200P, trade name, made by Mitsui Petrochemical Industries, Ltd.) having an average volume diameter of 6 μm, a density of 0.97 and a molecular weight of 5,000, which is prepared by freeze-grinding, by means of a blender. The thus prepared toner was mixed with a carrier in the same manner as in Example 1 to obtain a two-component developer.

EXAMPLE 3

The same components as in Example 1 were kneaded, ground, and classified to provide a toner having an average volume diameter of 11 μm. Then, 100 parts of the toner were dispersed and mixed with one part of fine titanium oxide particles having an average volume diameter of 0.1 μm and 0.5 part of polyethylene (Acumist B6, trade name, made by Allied Chemical Corporation) having an average volume diameter of 6 μm, a density of 0.96, and a molecular weight of 6,000, by means of a blender. The thus prepared toner was mixed with a carrier in the same manner as in Example 1 to obtain a two-component developer.

EXAMPLE 4

The same components as in Example 1 were kneaded, ground, and classified to provide a toner having an average volume diameter of 11 μm. Then, 100 parts of the toner was dispersed and mixed with one part of fine titanium oxide particles having an average volume diameter of 0.1 μm and 0.5 part of polyethylene (Acumist C5, trade name, made by Allied Chemical Corporation) having an average volume diameter of 5.5 μm, a density of 0.95, and a molecular weight of 2300, by means of a blender. The thus prepared toner was mixed with a carrier in the same manner as in Example 1 to obtain a two-component developer.

EXAMPLE 5

The same components as in Example 1 were kneaded, ground, and classified to provide a toner having an average volume diameter of 11 μm. Then, 100 parts of the toner were dispersed and mixed with one part of fine titanium oxide particles having an average volume diameter of 0.1 μm and 0.5 part of polyethylene (200P, trade name, made by Mitsui Petrochemical Industries, Ltd.) having an average volume diameter of 15 μm, a density of 0.97 and a molecular weight of 5,000, which is prepared by freeze-grinding, by means of a blender. The thus prepared toner was mixed with a carrier in the same manner as in Example 1 to obtain a two-component developer.

EXAMPLE 6

The same components as in Example 1 were kneaded, ground, and classified to provide a toner having an average volume diameter of 11 μm. Then, 100 parts of the toner were dispersed and mixed with one part of fine titanium oxide particles having an average volume diameter of 0.1 μm and 0.5 part of polyethylene (600P, trade name, made by Mitsui Petrochemical Industries, Ltd.) having an average volume diameter of 12 μm, a density of 0.97 and a molecular weight of 10,000, which is prepared by freeze-grinding, by means of a blender. The thus prepared toner was mixed with a carrier in the same manner as in Example 1 to obtain a two-component developer.

COMPARATIVE EXAMPLE 1

By following the same procedure as Example 1 except that the polyethylene fine powder was not used, a two-component developer was obtained.

COMPARATIVE EXAMPLE 2

By following the same procedure as Example 1 except that 0.5 part of calcium stearate (average volume diameter 1 μm) having a lubricative effect was used in place of the polyethylene fine powder, a two-component developer was obtained.

COMPARATIVE EXAMPLE 3

By following the same procedure as Example 2 except that a polyethylene fine powder having an average volume diameter of 20 μm was used, a two-component developer was obtained.

COMPARATIVE EXAMPLE 4

By following the same procedure as Example 1 except that 0.5 part of polyethylene (220P, trade name, made by Mitsui Petrochemical Corporation) having a density of 0.92 and a molecular weight of 5,000, said polyethylene being formed into a fine powder having an average volume diameter of 8 μm by freeze-grinding, was used in place of the polyethylene fine powder, a two-component developer was obtained.

COMPARATIVE EXAMPLE 5

By following the same procedure as Example 1 except that 0.5 part of polyethylene (PE-190, trade name, made by Hoechst A.G.) having a density of 0.96 and a molecular weight of 40,000, said polyethylene being formed into a fine powder having an average volume diameter of 9 μm by freeze-grinding, was used in place of the polyethylene fine powder, a two-component developer was prepared.

Copy Test

Using each of the dry developers obtained in Examples 1 to 3 and Comparative Examples 1 to 5, a continuous copy test was carried out on an electrophotographic copying machine (FX5075, trade name, made by Fuji Xerox Co., Ltd.) and the results shown in the following table were obtained. The continuous copy test consists of repetition of 999 copies and 10 seconds for rest by turns.

TABLE

| Additive | | | Tribo Charges | |
|---|---|---|---|---|
| Density[1)] | Particle Size[2)] | Molecular | Initial Tribo Charges[4)] | after copying 100,000 sheets |

TABLE-continued

| | Kind | (g/cm³) | (μm) | Weight[3] | (μq/g) | (μq/g) |
|---|---|---|---|---|---|---|
| Example 1 | PE | 0.97 | 8 | 9000 | 13 | 12 |
| Example 2 | PE | 0.97 | 6 | 5000 | 21 | 19 |
| Example 3 | PE | 0.96 | 6 | 6000 | 23 | 25 |
| Example 4 | PE | 0.95 | 5.5 | 2300 | 17 | 16 |
| Example 5 | PE | 0.97 | 15 | 5000 | 20 | 18 |
| Example 6 | PE | 0.97 | 12 | 10000 | 20 | 16 |
| Comparative Example 1 | — | — | — | — | 15 | 13 |
| Comparative Example 2 | CaSt[8] | — | 1 | | 12 | 4 |
| Comparative Example 3 | PE | 0.97 | 20 | 5000 | 21 | 19 |
| Comparative Example 4 | PE | 0.92 | 8 | 5000 | 15 | 12 |
| Comparative Example 5 | PE | 0.96 | 9 | 40000 | 15 | 13 |

| | Cleaning Performance[5] | Image Defect | Toner Storage Stability |
|---|---|---|---|
| Example 1 | ○ | No problem[6] | No problem[7] |
| Example 2 | ○ | No problem | No problem |
| Example 3 | ○ | No problem | No problem |
| Example 4 | Δ | No problem | No problem |
| Example 5 | Δ | No problem | No problem |
| Example 6 | Δ | No problem | No problem |
| Comparative Example 1 | X | From about 800 copies, black lines caused by poor cleaning occurred | No problem |
| Comparative Example 2 | Δ | Fogged image occurred after 100,000 copies due to the reduction of static property | No problem |
| Comparative Example 3 | X | From about 8,000 copies, black lines caused by poor cleaning occurred | No problem |
| Comparative Example 4 | X | From about 1,000 copies, black spots caused by sticking of PE onto the photoreceptor occurred | Toner aggregation occurred in machine |
| Comparative Example 5 | X | From about 1,000 copies, black lines caused by poor cleaning occurred | No problem |

Notes in Table

[1]The density was measured according to the method of JIS K6760.

[2]As the particle size, an average volume diameter $D_{50}$(Vol) was determined using Coulter counter (Type TA-II).

[3]The molecular weight was measured using a column (Shodex 80M/S+803S+802S) for liquid chromatograph (ALC/GPC150C). The column temperature was adjusted to 135° C., trichlorobenzene was passed as a solvent, after making a calibration curve using 10 kinds of TSK standard polystyrenes, polyethylene was dissolved in trichlorobenzene, and the molecular weight was measured.

[4]The tribo charges were measured by a blow off measuring device.

[5]Cleaning performance: With an untransferred black belt of 5 cm in width, 999 sheets mode × 3 times continuous test was performed on blade cleaning.

○: At copying 2,000 or more sheets, toner cleaning on the photoreceptor could be performed without any trouble.

Δ: At copying 1,000 to 1,999 sheets, cleaning became inferior.

X: At copying less than 999 sheets, cleaning became inferior.

[6]The term "no problem" means that in the 100,000th copy, image defects (black spots, black lines, fogged images, etc.) do not occur.

[7]The term "no problem" means that at copying the 100,000th sheet, neither aggregation nor condensation occurs.

[8]CaSt (Calcium Stearate) is a metal soap.

As is clear from the results shown in the above table, it can be seen that in the case of using the dry developers prepared in the examples of the present invention, a stable amount of static charges can be obtained and good images are formed. Furthermore, the dry developers of the present invention are excellent in cleaning property and there is no problem on the storage stability of the toner.

As described above, by employing the aforesaid construction of the dry developer of the present invention, the dry developer having remarkably improved cleaning property and excellent environmental stability and durability is obtained, and by forming an adequate polyethylene film or layer on a photoreceptor, the occurrences of a toner filming phenomenon on the photoreceptor and insufficient cleaning by attaching of paper dusts or powders can be prevented.

In particular, when a high-speed developing process of developing latent images travelling at a high speed is practiced in a system of using an organic belt photoreceptor and a developer containing a dispersion type carrier, the aforesaid effect becomes more remarkable.

While the invention has been described in detail and with reference to specific embodiments thereof, it will be apparent to one skilled in the art that various changes and modifications can be made therein without departing from the spirit and scope thereof.

What is claimed is:

1. A dry developer for an electrophotographic process, said dry developer comprising a toner and a dispersion type carrier composed of a resin and a magnetic powder, wherein fine powder having a molecular weight of not larger than 10,000, a density of at least 0.95, and an average volume diameter of not larger than 15 μm is externally added to the toner or directly mixed with the developer.

2. A dry developer for an electrophotographic process as in claim 1, wherein the content of polyethylene contained in the dry developer is from 0.01 to 10% by weight based on the total weight of the toner.

3. A dry developer for an electrophotographic process as in claim 1, wherein the mean particle size of the toner is less than about 30 μm.

4. A dry developer for an electrophotographic process as in claim 1, wherein the mean particle size of the toner is 3 to 20 μm.

5. A dry developer for an electrophotographic process as in claim 1, wherein the mean particle size of the carrier is about 20 to 400 μm.

6. A dry developer for an electrophotographic process as in claim 1, wherein the mean particle size of the carrier is 30 to 200 μm.

7. A dry developer for an electrophotographic process as in claim 1, wherein the average volume diameter of the polyethylene is not larger than 10 μm.

8. A dry developer for an electrophotographic process as in claim 1, wherein the polyethylene has a molecular weight of 900 to 10,000, a density of 0.95 to 0.99, and an average volume diameter of about 3 to 10 μm.

* * * * *

UNITED STATES PATENT AND TRADEMARK OFFICE

CERTIFICATE OF CORRECTION

PATENT NO. : 5,085,963

DATED : February 04, 1992

INVENTOR(S) : Chiaki Suzuki et al.

It is certified that error appears in the above-identified patent and that said Letters Patent is hereby corrected as shown below:

Claim 7, column 8, line 64, before "fine" insert --polyethylene--.

Signed and Sealed this

Twenty-second Day of June, 1993

*Attest:*

Michael K. Kirk

MICHAEL K. KIRK

*Attesting Officer*

*Acting Commissioner of Patents and Trademarks*